United States Patent [19]

Hauser

[11] Patent Number: 4,588,097

[45] Date of Patent: May 13, 1986

[54] SAFETY CLOSURE CAP FOR CONTAINERS

[76] Inventor: Ivo J. Hauser, 5 Winding La., Westport, Conn. 06880

[21] Appl. No.: 718,874

[22] Filed: Apr. 2, 1985

[30] Foreign Application Priority Data

Apr. 3, 1984 [CH] Switzerland ..... 1682/84

[51] Int. Cl.[4] ..... B65D 55/02

[52] U.S. Cl. ..... 215/216

[58] Field of Search ..... 215/216, 203, 224

[56] References Cited

U.S. PATENT DOCUMENTS 4,335,823 6/1982 Montgomery et al. ..... 215/216

4,376,497 3/1983 Mumford ..... 215/216

4,452,363 6/1984 Davis ..... 215/216

*Primary Examiner*—George T. Hall

*Attorney, Agent, or Firm*—Patrick J. Walsh

[57] ABSTRACT

A safety closure cap for containers in which the cap is pressed onto a container neck. The cap skirt comprises two or more pressure points for distorting the cap. The cap also includes expansion areas and means for fixing the rotational position of cap to container. The expansion areas contain closure segments which engage an endless closure bead located on the container neck. By means of rotating the cap to a predetermined position and by means of finger pressure applied on the pressure points the cap skirt is deformed which results in a deflection of the expansion areas in a radial direction and disengages the closure segments from the closure bead to allow the cap can be lifted up from the container.

10 Claims, 9 Drawing Figures

SAFETY CLOSURE CAP FOR CONTAINERS

BACKGROUND OF THE INVENTION

The present invention relates to safety closure caps for sealing containers designed particularly to impede access to the contents of the container by children. The safety closure cap has particular application in connection with containers for pharmaceuticals, medicines, household cleaners and so forth where it is desired particularly to keep children from gaining access to such contents.

There are many designs for container closures including, for instance, the container closure described in Swiss Pat. No. 556,274 where the closure cap is threaded for securing to a container having corresponding thread segments for receiving the closure cap. Such container closure cap is easily opened by means of a simple turn for disengaging the threaded cap from the threaded segments of the container. However, it is frequently desirable and in some cases a regulatory requirement for certain products such as medicines and pharmaceuticals to have containers equipped with a closure that is not easily opened in order to restrict access to the product, to children for example. A conventional safety closure cap includes a twist-on cap having an opening in its thread portion for alignment with a corresponding opening in the threads at the mouth of the container. In order to open or to remove the cap from the container the corresponding openings of cap and container must be aligned and the cap removed by lifting upwardly. In order to increase the difficulty of turning the cap, the closure is also equipped with cams which keep the cap in a secured position. In order to unlock the cap from the secured position a certain resistance has to be overcome. However, such mechanical resistance is of little advantage as it can easily be overcome in the hands of children.

Accordingly, the present invention is directed to container closures which provide excellent security against opening by unauthorized people and it is the task of the invention to avoid the disadvantages of container closures over prior art.

SUMMARY OF THE INVENTION

The present invention discloses a safety container closure having a greater degree of safety than container closures heretofore known. The container closure is designed such that when fitted to a container, the cap must first be turned or twisted to a predetermined position with respect to the container and then the opposite sides of the cap must be pressed or squeezed together slightly in order to release the means by which the container closure engages and seals the container so that the closure cap can now be removed from the container. This principle of design and operation of the container closure is not easy to recognize by unauthorized persons, in particular, children. In consequence, a high degree of safety is achieved. At the same time the closure is easily opened as it does not require great force for such manipulation once the opening technique is understood. This is particularly advantageous to persons with arthritic hands who often have difficulty using container closures known in the prior art as it is often difficult and painful for such persons to manipulate prior art container closures.

In one form of the invention there is provided a generally circular closure cap having a top panel and dependent skirt with closure segment means for engaging a continuous bead formed around the container mouth. Additionally, there are locking lugs formed on the innerside of the container closure cap skirt which engage corresponding locking cams formed at the shoulder of the container. For opening this arrangement of the invention the container closure is twisted approximately 90° from closed position to position for opening. Thereafter opposite sides of the closure are squeezed in order to flex the circular container closure into an oblong or elliptical configuration. The closure segment means are then in the vicinity of the major axis of the elliptical cap and disengage from the continuous neck bead of the container. Conveniently there are provided alignment notches in the container closure for alignment with a corresponding notch in the surface of the container. In a configuration of this kind the container closure may be continuously rotated without resulting in removal of the closure from the container. Unless the rotation is stopped in predetermined position of closure with respect to container any following squeezing action with the closure cap will not be effective unless the closure retaining lugs are aligned along and squeezed along a minor axis of the elliptical removal position. In such condition and position of the closure with respect to container, the closure segments of the cap will be at a small angle to the major axis and therefore readily disengaged.

In a modified embodiment of the invention a rectangular or square closure cap is provided for a container having a generally cylindrical mouth and generally rectangular main body portion. The mouth of the container is provided with an endless bead for engaging closure segments on the closure cap for securing the cap to the container. The shoulder of the container is provided with locking cams located at the four corners of the rectangular configuration of the bottle. For removal of a closure cap of this configuration of the invention the closure is rotated approximately 45° with respect to the container so that the segments on the interior surface of the skirt disengage from the endless bead around the container neck. In addition, the bottom portion of the container closure skirt must be free of the container shoulder locking cams such that opposing points on the container closure by being squeezed are effective to release the closure from the container. In this form of the invention the container closure has to be squeezed using both hands from opposite corners. In this manner the closure segments are disengaged from the endless bead on the container.

In another form of the invention the container comprises a generally rectangular shape having a mouth with an endless bead. The container closure is provided with inwardly extending lugs for engaging the retaining bead on the mouth of the container. The corners on the inside of the closure skirt are recessed to provide for preferred flexing of the closure such that on rotation and squeezing of the closure one of the lugs disengages from the container retaining bead providing for upward tilting and removal of the container closure.

According to the invention the cross-section of the container closure cap can be of any shape, round, oval, or with several corners polygonal in shape, having the advantage to identify the pressure points with the corners.

In each embodiment of the invention the wall thickness of the cap skirt can be constant along its circumference or perimeter. However it is advantageous to design the cap skirt whereby it facilitates the squeezing action such that the degree of flexing of the container closure at the depending skirt area can be controlled.

According to the present invention the safety characteristics of the closure and the container elements provide a high degree of security from inappropriate access, particularly by children.

According to the invention it is highly desirable to fabricate the container closure of plastic material, particularly injection molded plastic. The container may also be of plastic or glass or other material conventionally used for such containers.

OBJECTS OF THE INVENTION

It is an object of the invention to provide a container closure designed for safety and ease of operation.

Another object of the invention is to provide a container closure in which the closure is first rotated with respect to the container thereafter squeezed manually to disengage the closure retaining means from the container retaining means.

Another object of the invention is to provide an arrangement between closure and container wherein the closure may be continuously rotated without being removable from the container as a basic safety feature.

Another object of the invention is to provide for removal of the container closure after partial rotation to a predetermined position, flexing the container closure and removal of the closure from the container from such predetermined position.

A further object of the invention is to provide closure caps which may be circular, oval or polygonal in shape while embodying the present invention.

Another object of the invention is to provide a closure cap having recesses positioned in the wall of the closure skirt strategically located to provide for preferential flexing of the cap for convenient removal from the container.

Other and further objects of the present invention will occur to one skilled in the art upon employment of the invention in practice and upon an understanding of the detailed description of the invention.

DETAILED DESCRIPTION OF THE DRAWING

Several embodiments of the invention have been chosen for illustration and are shown in the accompanying drawing in which.

DETAILED DESCRIPTION OF THE INVENTION

Figure 1:
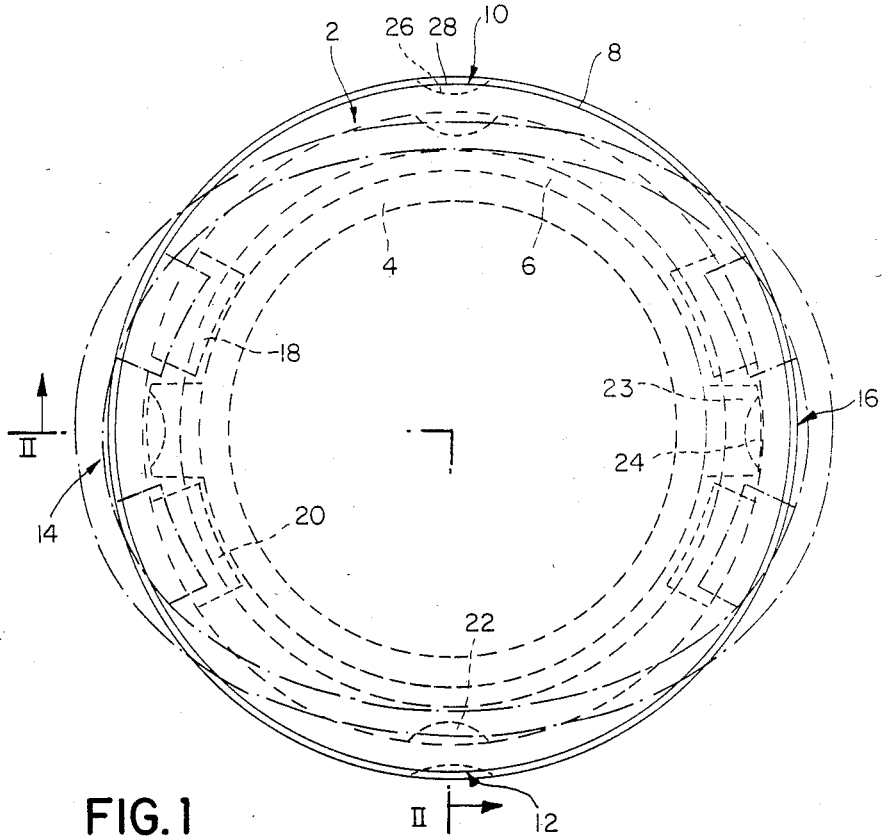
FIG. 1 is a top plan view of a generally circular closure cap according to the present invention showing the cap in secured position with respect to a container and in dot-dash lines rotation and flexing of the container closure in a position for removal from the container.
Figure 2:
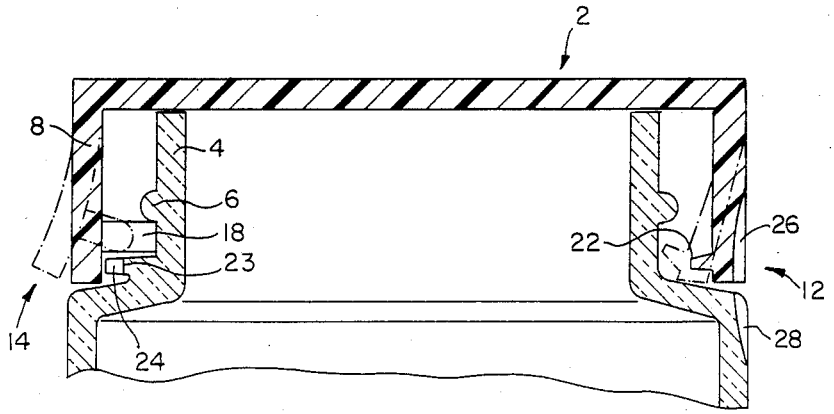
FIG. 2 is a section view taken along line II—II of FIG. 1.
Figure 3:
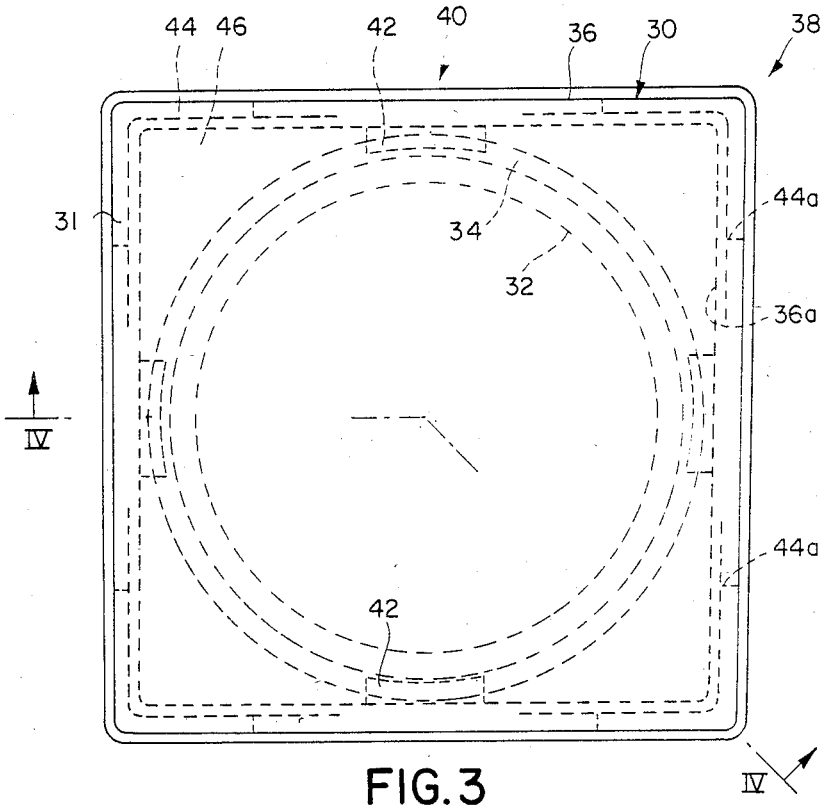
FIG. 3 shows a modification of a closure cap according to the present invention in which the cap is essentially square in configuration and is shown in the closed position with respect to a container.

Referring now to FIGS. 1 and 2, there is illustrated one form of closure cap 2 according to the invention fitted to a container 3. The container includes an outer side wall 3*a*, a shoulder area 3*b*, and a generally cylindrical neck portion 4. An endless closure bead 6 encircles the outer surface of the neck and provides for securing the closure cap to the container. The container is also provided with a pair of locking cams 23 extending radially outwardly from the container neck 4 and defining locking cavities 24 at the container shoulder. The locking cams 23 are at diametrically opposed locations on the container neck and extend a short distance circumferentially thereof. The container itself may be formed of glass, plastic, or metal according to known methods.

The closure cap 2 includes a top panel 7 of generally circular shape and a skirt 8 depending from the periphery of the top panel. The cap skirt is provided with pressure points indicated by 10 and 12 at diametrically opposed locations. These pressure points are defined by cavities or indentations 26 in the outer surface of the cap skirt extending approximately from the lower edge of the skirt to the mid-point of the skirt wall. The pressure points are preferably shaped to accommodate adult finger tips applied for removing the cap in a manner to be described.

A pair of locking lugs 22 extend radially inwardly from the interior surface 8*a* of the cap skirt. The locking lugs are located at opposite sides of the closure cap in the vicinity of pressure points 10 and 12. The locking lugs are positioned to enter and exit locking cavities 24 by rotating the cap on the container neck for the purpose of locking the cap to the container to prevent prying the cap off.

The cap skirt includes two sets of closure segments 18 and 20 extending radially inwardly from the inner skirt surface for engaging the closure bead 6 and securing the cap to the container. The closure segment sets are located at opposed expansion or flexing areas of the cap so that as the cap is distorted in a manner to be described, the closure segments disengage the closure bead for removal of the cap.

In order to close the container, the cap is merely pressed at the container neck. In sealed position, the closure cap is positioned 90° from that illustrated in solid and dash lines in FIG. 1. In such sealed position, both sets of closure segments 18, 20 engage the closure bead and the locking lugs 22 are within the locking cavities 24. Any attempt to remove the cap by applying a squeezing force at pressure points 10 and 12 will be ineffective in that lugs 22 and cams 23 cooperate to resist such force and the cap will not flex. Additionally, the locked position of lug and cam avoids involuntary turning of the cap from locked to unlocked by reason of the location of the lugs within the cavities 24.

In oder to open the container, the cap is twisted 90° to the position shown in FIGS. 1 and 2. In such position one of the pressure point indentations 26 is vertically aligned with a complementary indentation 28 at the shoulder of the container. Next, finger pressure is applied at pressure points 10 and 12 in order to distort or flex the cap to the dot-dash line position of FIGS. 1 and 2. The flexing results in an outward excursion of expansion areas 14 and 16 of the cap so that both sets of closure segments 18 and 20 are released from engagement with the closure bead 6 and the cap is lifted off.

Another form of a closure cap 30 according to the invention is illustrated in FIGS. 3–6. In this application, the container body is preferably square and has a generally cylindrical neck with an endless closure bead for securing closure cap to container. The shoulders of the container are provided with a plurality of locking cams 46 located at the four corners of the container for engaging a corresponding plurality of safety bands 44 depending from the lower edge of the cap 30 as more fully described below.

Figure 4:
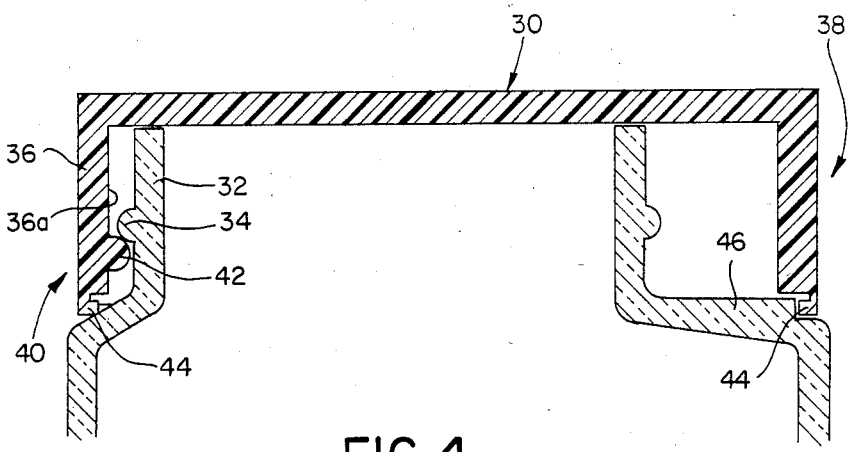
FIG. 4 is a section view taken along line IV—IV of FIG. 3.

The cap 30 is rectangular, preferably square in form, has a top panel 31 and a peripheral depending skirt 36. A plurality, preferably four, closure segments 42 extend inwardly from the inner surface 36*a* of the skirt for engaging the endless bead and securing the cap to the container as shown in FIG. 4. The four corners 38 of the cap define pressure points and the side walls of the cap skirt in the vicinity of closure segments 42 define expansion or flexing areas 42 of cap skirt to facilitate removal of the cap in a manner described below. A plurality of safety bands, one at each corner of the closure cap, depend from the lower edge of the skirt 36 for engagement with locking cams 46. The safety bands extend partially along the skirt away from each corner to points 44*a* shown in FIG. 4. Engagement of the safety bands with locking cams prevents unintentional turning of the closure cap, application of a squeezing force to pressure points 38 of the cap, and the bands, when intact, provide visual evidence that the container has not been previously opened or tampered with.

Figure 5:
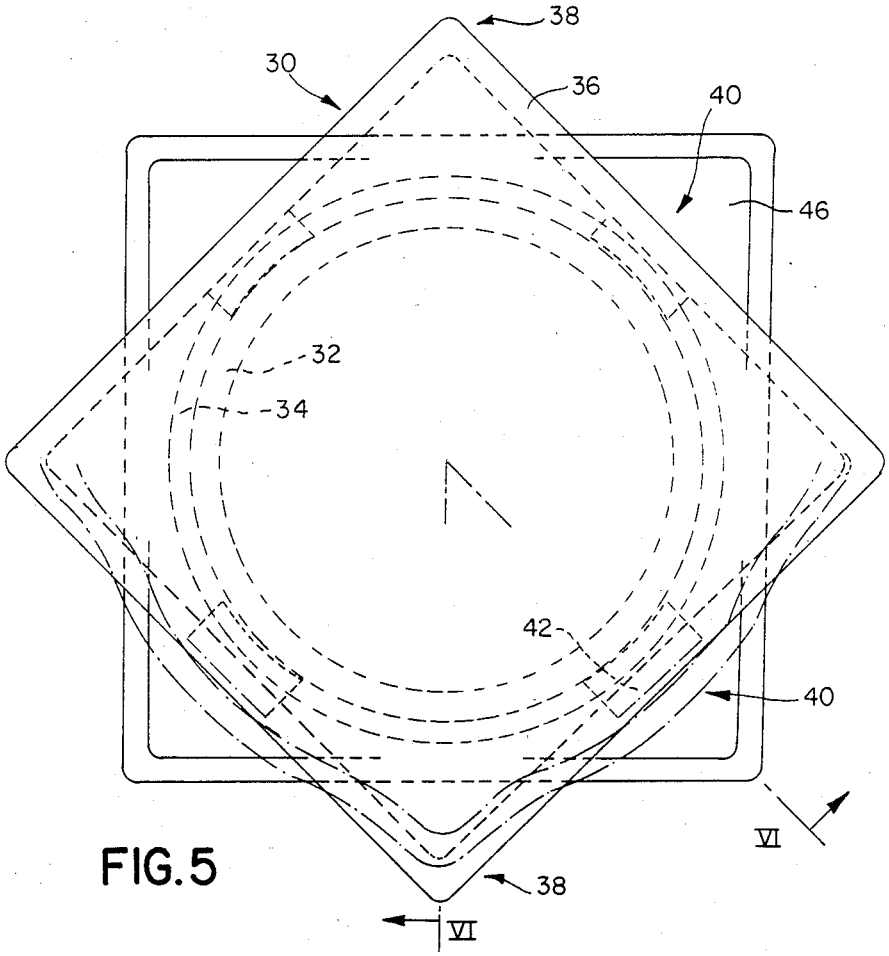
FIG. 5 is a top plan view of the container closure of FIG. 3 rotated from closed to opening position and particularly showing in dot-dash lines the flexing of the closure to disengage the closure from the container retaining bead.
Figure 6:
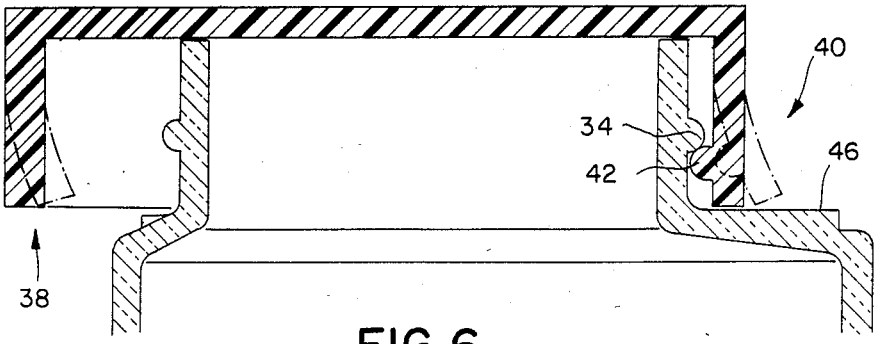
FIG. 6 is a section view taken along line VI—VI of FIG. 5.

The opening of the cap is shown in FIGS. 5 and 6 and occurs as follows. First the cap is turned approximately 45° in either direction fracturing the safety bands now allowing the lower edge of the cap skirt corners to pass over the surface of the locking cam as shown in FIG. 6. In this position finger pressure is applied to the cap at each pressure point 38. This action flexes the cap and distorts the skirt radially outwardly in the vicinity of the closure segments as shown in the dot-dash lines in FIG. 5. The distortion represented by such lines occurs symetrically of the cap. As a result, each closure segment moves away from the endless closure bead and the cap is removed from the container. As in the case of the embodiment of FIGS. 1 and 2, the cap is applied to the container by pressing it onto the container neck.

Figure 7:
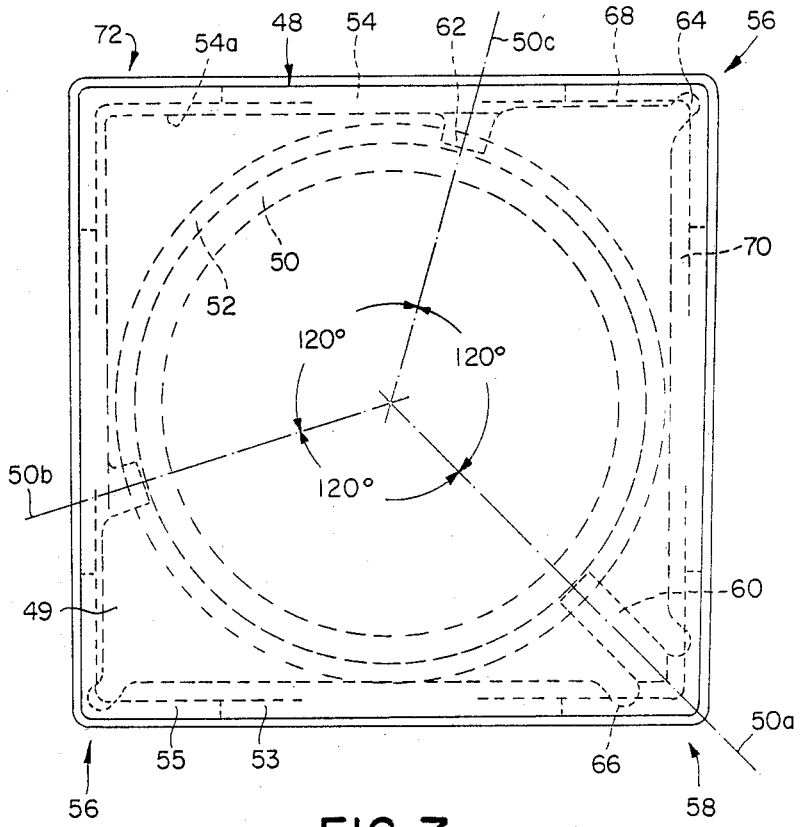
FIG. 7 is a further modification of the closure cap according to the present invention shown in top plan and shown in sealing relationship to a container.
Figure 8:
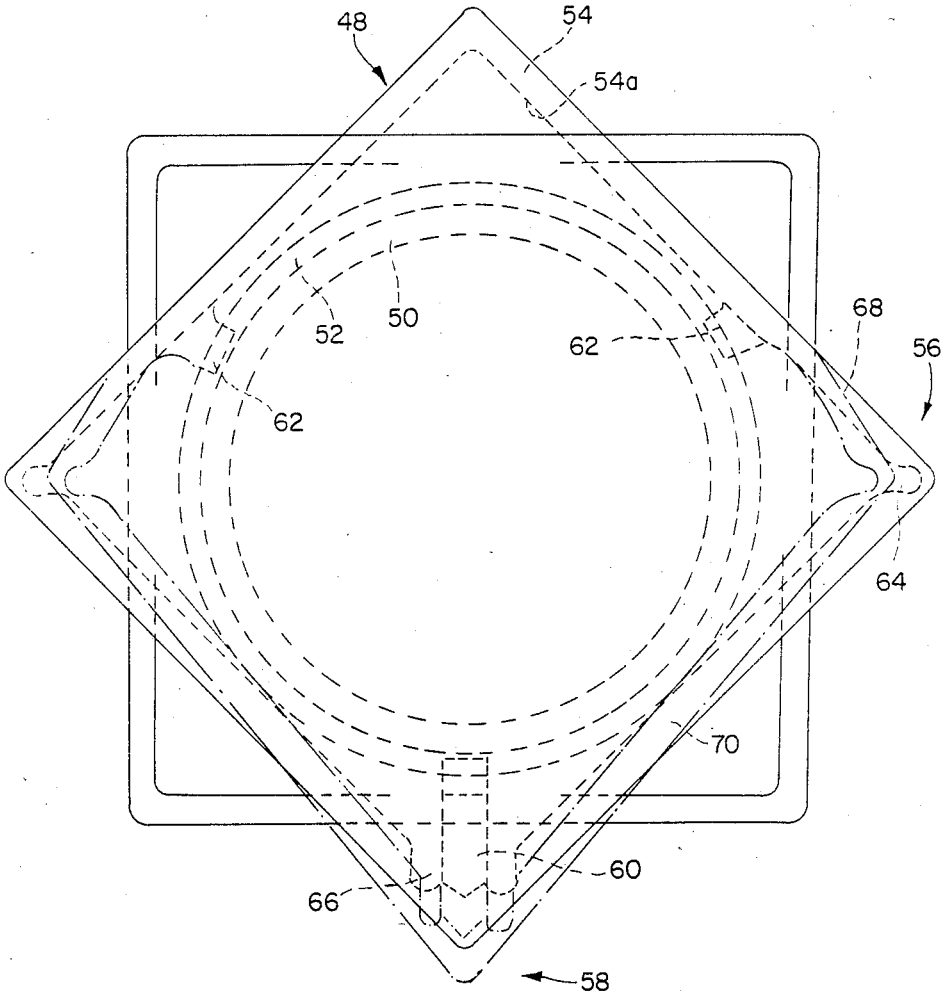
FIG. 8 is a view corresponding to that of FIG. 7 in which the closure has been rotated 45 and flexed along the dot-dash lines to disengage the closure from the container.

A third form of the invention is illustrated in FIGS. 7 and 8. The container is of the same configuration as that used for the cap of FIGS. 3–6, and includes a container neck 50, an endless bead 52 encircling the neck for securing the closure cap, and a locking cam 53 for cooperation with safety bands 55 depending from the bottom edge of the cap skirt 54 in the same manner and for the same purposes as in the embodiment of FIGS. 3–6.

The closure cap 48 is rectangular and preferably square and has a top panel 49 and a depending endless skirt 54. The inner surface of the closure cap is provided with a first closure segment 60 extending inwardly from one corner 58 of the cap along diametrical line 50*a* into engagement with the endless container bead. The inner surface 54*a* of the cap skirt is recessed at 66 on either side of closure segment 60 to facilitate outward flexing of corner 58 as an expansion area of the cap.

Second and third closure segments 62 extend inwardly from the inner surface of the cap skirt into engagement with closure bead 52 for securing cap to container. The closure segments 62 are located along container diameters 50*b* and 50*c* and are positioned 120° from each other and from closure segment 60 about the circumference of the container neck.

Opposite corners 56 of the closure define pressure points for applying a distorting force to the cap prior to removal. The inner surface of the cap skirt is recessed at 64 to accommodate flexing of the cap skirt at pressure point corners 56 for removing the cap. Additionally, the inner surface of the cap skirt is recessed at areas 68, i.e., the skirt wall is made thinner through its full depth to promote flexing of those portions when force is applied to pressure points 56. The skirt wall at areas 70 between the pressure points and the expansion area 58 is reinforced to avoid flexing so that flexing action is directed toward the expansion area 58. Finally, the remaining corner 72 of the cap skirt is not recessed or weakened so it resists distortion or flexing of the cap when pressure is applied at corners 56.

For removal, the cap (FIG. 8) is turned approximately 45 for breaking off the safety bands 55 as they encounter the resistance of locking cams 53. Next, manual pressure is applied to pressure points 56 causing a preferential distortion of the cap skirt at wall areas 68 and at recesses 64 toward expansion area 58 as shown by dot-dash lines. This action disengages first closure segment 60 from closure bead 52 while second and third segments remain in engagement with the bead. For removal of cap is must now be lifted or tilted first at corner 58 over the container neck and withdrawn in the direction of corner 72 for disengagement or container segments 62.

The cap of FIGS. 7 and 8 is also applied by a press on technique.

Figure 9:
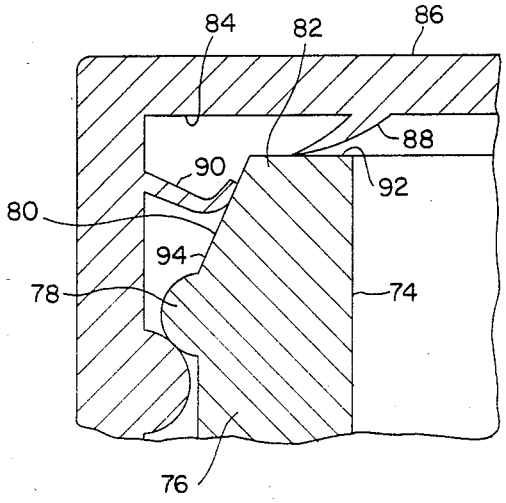
FIG. 9 is a fragmentary section view of a modification to the embodiment of FIGS. 7 and 8 in which the closure cap has a twin lip sealing system.

There is illustrated in FIG. 9, a form of the twin lip sealing system for closure caps disclosed in my copending United States application Ser. No. 670,040, filed Nov. 13, 1984. As shown a container 74 is provided with neck 76, endless bead 78, and angled sealing surfaces 80, 82. The inside surface 84 of the closure cap 86 is fitted with sealing lips 88, 90 in a manner more particularly described in said copending application. Primary sealing lip 88 engages the top sealing surface 92 and secondary sealing lip 90 engages the side sealing surface 94 of the container. When this sealing lip system is used with the safety closure cap of FIGS. 7 and 8 herein, the twin sealing lips will aid upward tilting of the expansion corner 58 by reason of the compressive force existing between the sealing lips 88, 90 and the sealing surfaces 92, 94 of the container neck.

It is to be understood that it is within the present invention to provide a closure cap having a construction for merely applying pressure at pressure points for disengaging the closure segments from the endless container neck bead.

In the embodiment of FIGS. 1 and 2 the locking lugs 22 and the locking cams 23 may be omitted so that the closure cap may be removed on application of pressure to pressure points 10 and 12 to disengage closure segments 18, 20 from bead 6.

Similarly, in FIGS. 3–6 (and in FIGS. 7–9) safety bands 44 (55) and locking cams 46 (53) may be omitted to allow opening of the cap by applying pressure at pressure points 38 (56).

Such modifications are permitted where the safety feature is not needed in view of the product being packaged.

It will be understood there are other designs which may be devised in carrying out the principles of this invention including the interchanging design features of the several embodiments disclosed herein.

I claim:

1. Container closure cap having closure segments for a container having a neck encircled with an endless closure bead which can be opened by hand, comprising a top panel, a cap skirt having at least two pressure points and at least one expansion area for deforming the cap by exerting a pressure on the pressure points, said expansion area being located intermediate the pressure points, and having a closure segment engaging the closure bead whereby pressure exerted on the cap skirt at the pressure points causes a deflection of the expansion area and a simultaneous disengagement of at least one closure segment located in the expansion area.

2. Container closure cap as defined in claim 1, in which the cap skirt comprises at least one closure segment located opposite the expansion area.

3. Container closure cap as defined in claim 1, in which the cap skirt has a closure segment located in the expansion area and additional segments in an area located opposite to the expansion area whereby these additional segments do not disengage the container bead during exertion of a pressure on the pressure points.

4. Container closure cap as defined in claim 1, in which the cap skirt comprises four symmetrically position pressure points located between outwardly directed expansion areas having inwardly directed closure segments.

5. Container closure cap as defined in claim 4, in which the cap has four symmetrically positioned corners, whereby the pressure points are located in the corners.

6. Container closure cap as defined in claim 1, in which the cap skirt has weak areas located in the vicinity of the pressure points and in the expansion areas in order to facilitate the deformation of the cap skirt upon application of force to the pressure points.

7. Container closure cap as defined in claim 6, in which the cap skirt has reinforced areas achieved by means of an increased wall thickness, located between the pressure points and the expansion area in order to direct distortion of the closure toward the expansion area.

8. Container closure cap as defined in claim 1, in which the cap can be turned between a locked position in which the pressure points cannot be activated, and an unlocked position in which the pressure points can be activated in order to achieve a distortion of the cap in the expansion area.

9. Container closure cap as defined in claim 8, in which the container neck has locking cams which secure the pressure points and resist the effectiveness of force applied to the pressure points.

10. Container closure as defined in claim 1, in which a tamper evident feature is added, consisting of an integrated safety band attached and located at the cap skirt in the region of the pressure points and which is also located on a safety cam of the container neck and therefore the pressure points cannot be activated and the cap cannot be turned without detaching the safety band from the cap skirt thereby indicating a tampered container.

* * * * *